US010538387B2

(12) United States Patent
Lu

(10) Patent No.: US 10,538,387 B2
(45) Date of Patent: Jan. 21, 2020

(54) GARBAGE BIN WITH COVER CAPABLE OF BEING FIXEDLY OPENED

(71) Applicant: Jinlong Industrial Co., LTD., Jiangmen (CN)

(72) Inventor: Huanbang Lu, Jiangmen (CN)

(73) Assignee: JINLONG INDUSTRIAL CO., LTD., Jiangmen (CN)

( * ) Notice: Subject to any disclaimer, the term of this patent is extended or adjusted under 35 U.S.C. 154(b) by 262 days.

(21) Appl. No.: 15/696,071

(22) Filed: Sep. 5, 2017

(65) Prior Publication Data

US 2019/0009982 A1 Jan. 10, 2019

(30) Foreign Application Priority Data

Jul. 10, 2017 (CN) ..... 2017 2 0833737 U

(51) Int. Cl.
*B65F 1/16* (2006.01)
*B65D 5/66* (2006.01)
*B65D 43/24* (2006.01)

(52) U.S. Cl.
CPC ..... *B65F 1/163* (2013.01); *B65D 5/6614* (2013.01); *B65D 43/24* (2013.01); *B65F 1/1615* (2013.01); *B65F 1/1623* (2013.01); *B65D 2251/1008* (2013.01); *B65F 2001/1669* (2013.01); *B65F 2210/148* (2013.01)

(58) Field of Classification Search
CPC B65F 1/163; B65F 1/1615; B65F 2001/1669; B65F 2210/148; B65F 1/1623; B65D 5/6614; B65D 43/24; B65D 2251/1008
USPC ..... 220/908, 832, 831
See application file for complete search history.

(56) References Cited

U.S. PATENT DOCUMENTS 930,245 A * 8/1909 Ufford ..... B65D 43/24 217/61
1,068,274 A * 7/1913 Reynolds ..... B65D 43/24 126/389.1
5,011,036 A * 4/1991 Souza ..... B65F 1/163 220/263
5,511,807 A * 4/1996 Snyder ..... B65F 1/1468 220/832
6,138,855 A * 10/2000 Kopf ..... B65F 1/1623 220/263
6,345,725 B1 * 2/2002 Lin ..... B65F 1/1607 220/263

(Continued)

*Primary Examiner* — Andrew T Kirsch
*Assistant Examiner* — Jennifer Castriotta
(74) *Attorney, Agent, or Firm* — Patrick J Halloran

(57) ABSTRACT

A garbage bin with a cover capable of being fixedly opened, comprises a bin body and a movably opened/closed cover mounted on the bin body, wherein a support is arranged at one end of the cover connected to the bin body, a locking member capable of protruding from the support is movably arranged in the support, a bin shoulder is arranged on the bin body, the bin shoulder is provided with a through hole for the support to penetrate through in a matching manner, the locking member is snap-fitted with the bin shoulder, a toggle rod protruding from the support is convexly arranged at one side of the locking member facing the center of the bin body, and a spacing hole for the toggle rod to penetrate through in a matching and receiving manner is arranged at the front side of the support.

20 Claims, 4 Drawing Sheets

(56) References Cited

U.S. PATENT DOCUMENTS

| | | | | |
|---|---|---|---|---|
| 8,074,833 | B2 * | 12/2011 | Yang | B65F 1/08 220/262 |
| 2013/0248471 | A1 * | 9/2013 | Evans | B65F 1/141 211/71.01 |

* cited by examiner

GARBAGE BIN WITH COVER CAPABLE OF BEING FIXEDLY OPENED

CROSS-REFERENCE TO RELATED APPLICATIONS

This application claims priority benefit of the China Patent Application titled, "GARBAGE BIN WITH COVER CAPABLE OF BEING FIXEDLY OPENED," filed on Jul. 10, 2017 and having Serial No. 201720833737.0. The subject matter of this related application is hereby incorporated herein by reference.

BACKGROUND OF THE INVENTION

Technical Field

The disclosure relates to a garbage bin, particularly to a garbage bin with a cover capable of being stationary opened.

Field of the Invention

Currently, general garbage bins for indoor uses are often designed with a pedal or other mechanisms for opening the cover, i.e. the cover is opened by stepping on the pedal or other mechanisms before the garbage is discarded into the garbage bin. At this time, a user needs to step on the pedal continually to keep the cover in an open position. When the user was unable to keep stepping on the pedal, the cover could not stay open, and the garbage bin is quite inconvenient to use under certain situations. Thus, these garbage bins prohibit easy and convenient discarding of garbage and have significant defects in function.

SUMMARY OF THE INVENTION

To overcome the defects of the prior art, the disclosure provides a garbage bin with a cover capable of being fixedly opened, which has the advantages of simple structure, convenient use, and more comprehensive functions.

The disclosure adopts the following technical solution to solve the technical problems:

A garbage bin with a cover capable of being fixedly opened, comprising a bin body and a movably opened/closed cover mounted on the bin body, wherein a support is arranged at one end of the cover connected to the bin body; a locking member capable of protruding from the support is movably arranged in the support; a bin shoulder is arranged on the bin body, the bin shoulder being provided with a through hole for the support to penetrate through in a matching manner; the locking member is capable of snap-fitting with the bin shoulder; a toggle rod protruding from the support is convexly arranged at one side of the locking member facing the center of the bin body; and a spacing hole for the toggle rod to penetrate through in a matching and receiving manner is arranged at the front side of the support.

In one or more embodiments, the locking member is a batten-shaped lock tongue. The back surface of the support is horizontally provided with a spacing groove for correspondingly limiting the horizontal movement of the locking member. A lock opening for receiving the locking member is arranged at the edge of the support located at one side of the spacing groove. The spacing hole corresponds to the bottom surface of the spacing groove.

In one or more embodiments, the inner walls of the upper and lower sides of the spacing groove are provided with an individual elastic inverted buckle, respectively, and an edge surface inclining inward obliquely towards the middle of the spacing groove is arranged at the end of the inverted buckle.

In one or more embodiments, a positioning part is convexly arranged at one side of the locking member facing the bottom surface of the spacing groove. A recessed part corresponding to the positioning part for limiting is arranged on the bottom surface of the spacing groove, the recessed part being provided with at least two recessed positions matching the positioning part. The bottom surface of the recessed part between the recessed positions is slanted downwards in the direction of the lock opening correspondingly.

In one or more embodiments, the bin body is further provided with a descent control device positioned below the support, which is provided with a strut abutting against the support at the top, and the lower end of the support is provided with a plate abutting against the strut.

In one or more embodiments, the abutting plate is convexly provided with an inserting plate and an inverted hook, the lower part of the support is provided with an inserting groove for corresponding insertion of the inserting plate and the inverted hook. A wall at one side of the inserting groove is provided with an opening for snap-fitted with the inverted hook.

In one or more embodiments, the support is connected with a connecting rod of a cover prop mechanism. The top end of the connecting rod is inserted in the inserting groove in a matching manner. The connecting rod is tightly clamped by the abutting plate and the inner wall of the inserting groove together.

In one or more embodiments, the top end of the connecting rod is in a corresponding n-shape or L-shape and extends along the edge of the inserting plate in a matching manner and is fitted with the inner wall of the inserting groove.

The garbage bin in the above embodiment has the beneficial effects that: the cover of this product can be locked to keep a fixed opening state as long as the toggle rod is simply toggled to move the locking member into snap-fitting with the bin shoulder, so as to prevent the support from falling off. The operation is convenient and quite flexible, thereby further solving the defects of traditional garbage bins.

BRIEF DESCRIPTION OF THE DRAWINGS

The embodiments will be further described below with reference to the accompanying drawings, wherein.

DETAILED DESCRIPTION OF EMBODIMENTS

Figure 1:
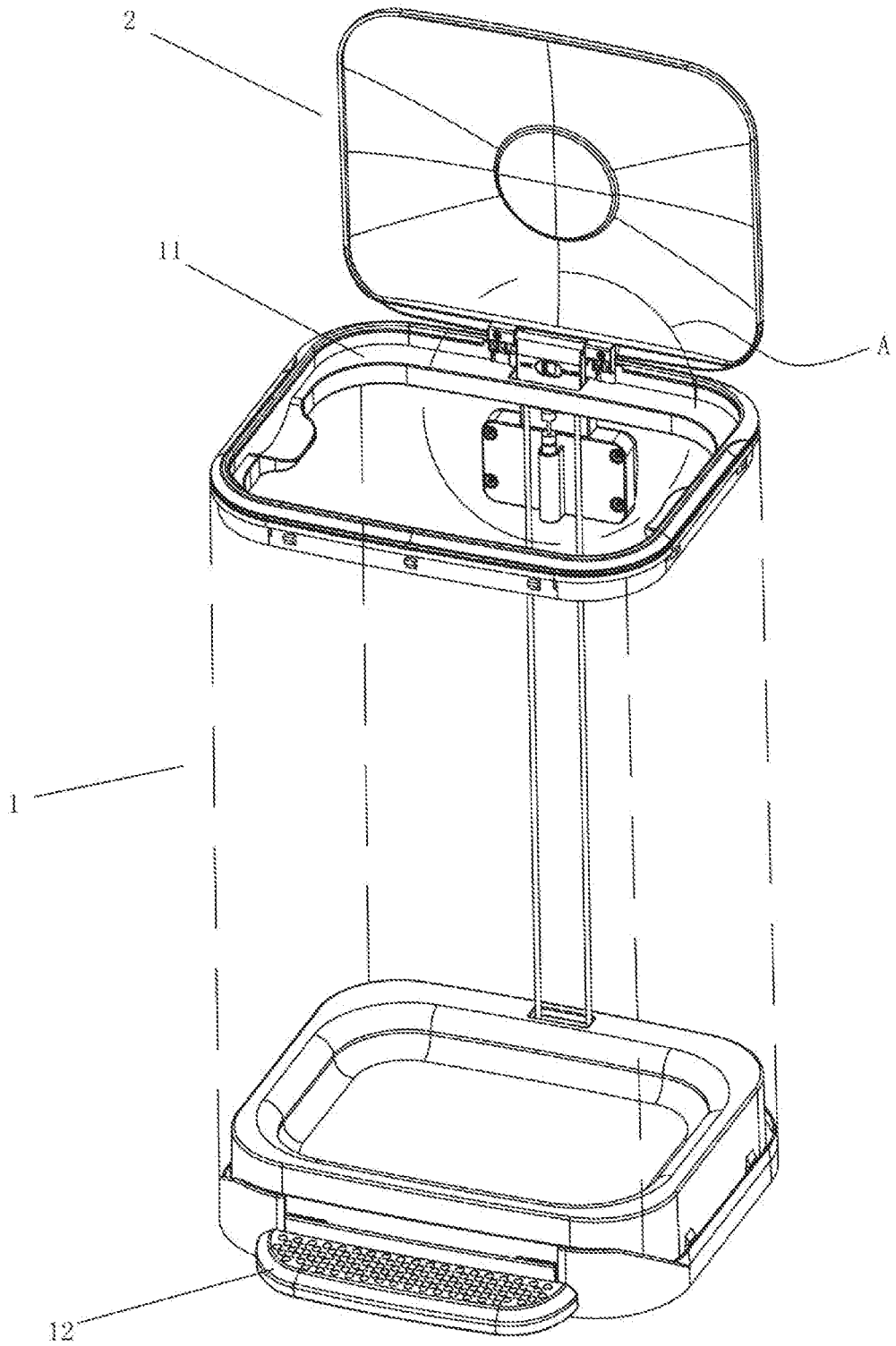
FIG. 1 is a schematic view of an installation structure in accordance with an embodiment.
Figure 2:
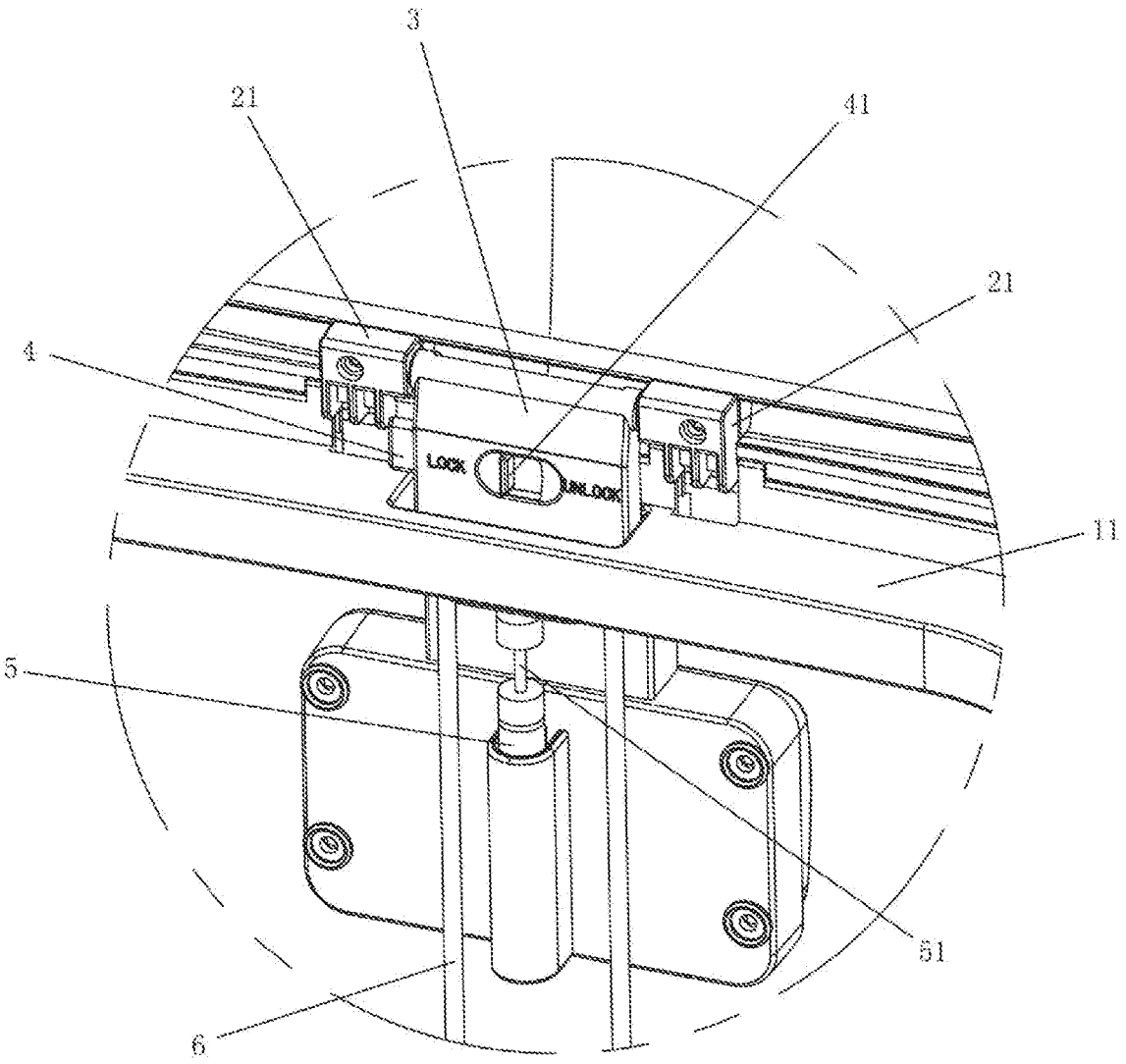
FIG. 2 is a partially enlarged schematic view of part A in FIG. 1.

Referring to FIGS. 1 and 2, a garbage bin with a cover capable of being fixedly opened of the disclosure, comprising a bin body 1 and a movably opened/closed cover 2 mounted on the bin body 1, wherein a support 3 for supporting and propping open the cover 2 is arranged at the end of the cover 2 connected to the bin body 1; a locking member 4 capable of protruding from the support 3 is movably arranged in the support 3; a bin shoulder 11 is arranged at the opening edge of the bin body 1; the bin shoulder 11 is provided with a through hole for the support 3 to penetrate through in a matching mode; the locking member 4 protrudes from the support 3 and snap-fits with the bin shoulder 11 when the locking member 4 moves upwards beyond the bin shoulder 11 with the support 3; a toggle rod 41 protruding from the support 3 is convexly arranged at one side of the locking member 4 facing the center of the bin body 1; a spacing hole 32 for the toggle rod 41 to penetrate through in a matching and receiving manner is arranged at the front side of the support 3; a pedal 12 and a cover prop mechanism are arranged at the bottom of the bin body 1, and the cover prop mechanism is connected with the pedal 12 and the support 3, respectively; and the support 3 is driven to move upwards by stepping the pedal 12 to open the cover 2. At this time, through manual operation of the toggle rod 41, the locking member 4 is moved out from the support 3 and then snap-fitted with the bin shoulder 11, thereby locking the movement of the support 3 and keeping the cover 2 open. The toggle rod 41 can only move within the range of the spacing hole 32, thus the moving range of the locking member 4 is also limited. The toggle rod 41 protrudes from the front side of the support 3 to facilitate the user to directly open the cover. A hinge component 21 is arranged at the end of the cover 2 connected to the bin body 1, and one side of the hinge component 21 extends to the bin shoulder 11 and is hinged therewith. Meanwhile, both sides of the upper end of the support 3 are hinged with the hinge component 21, so that when the support 3 is jacked by the cover prop mechanism, the cover 2 can be driven to rotate and open taking the hinge point between the hinge component 21 and the bin shoulder 11 as the center of a circle.

Figure 3:
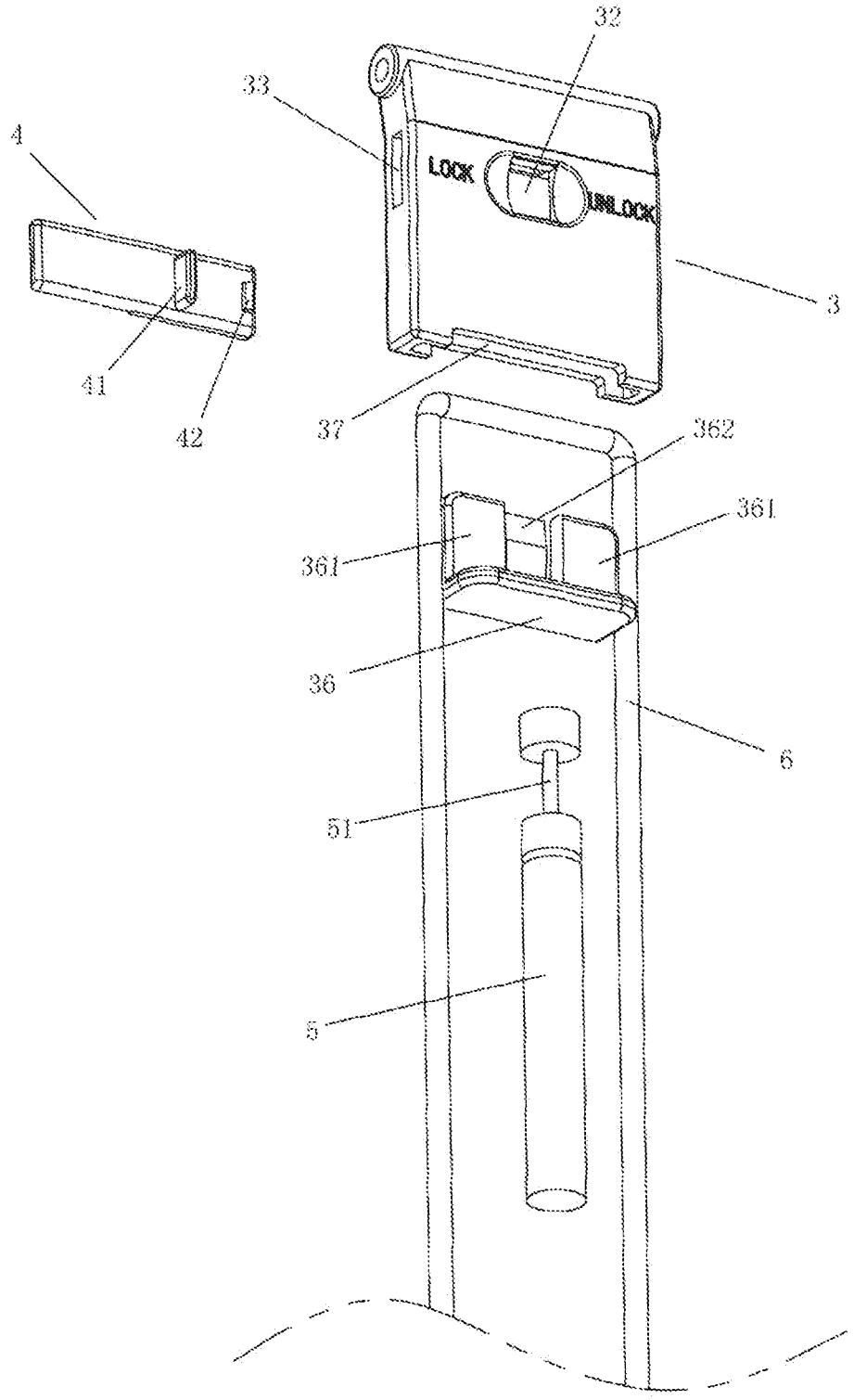
FIG. 3 is a partially exploded schematic view of components at a support of the disclosure.
Figure 4:
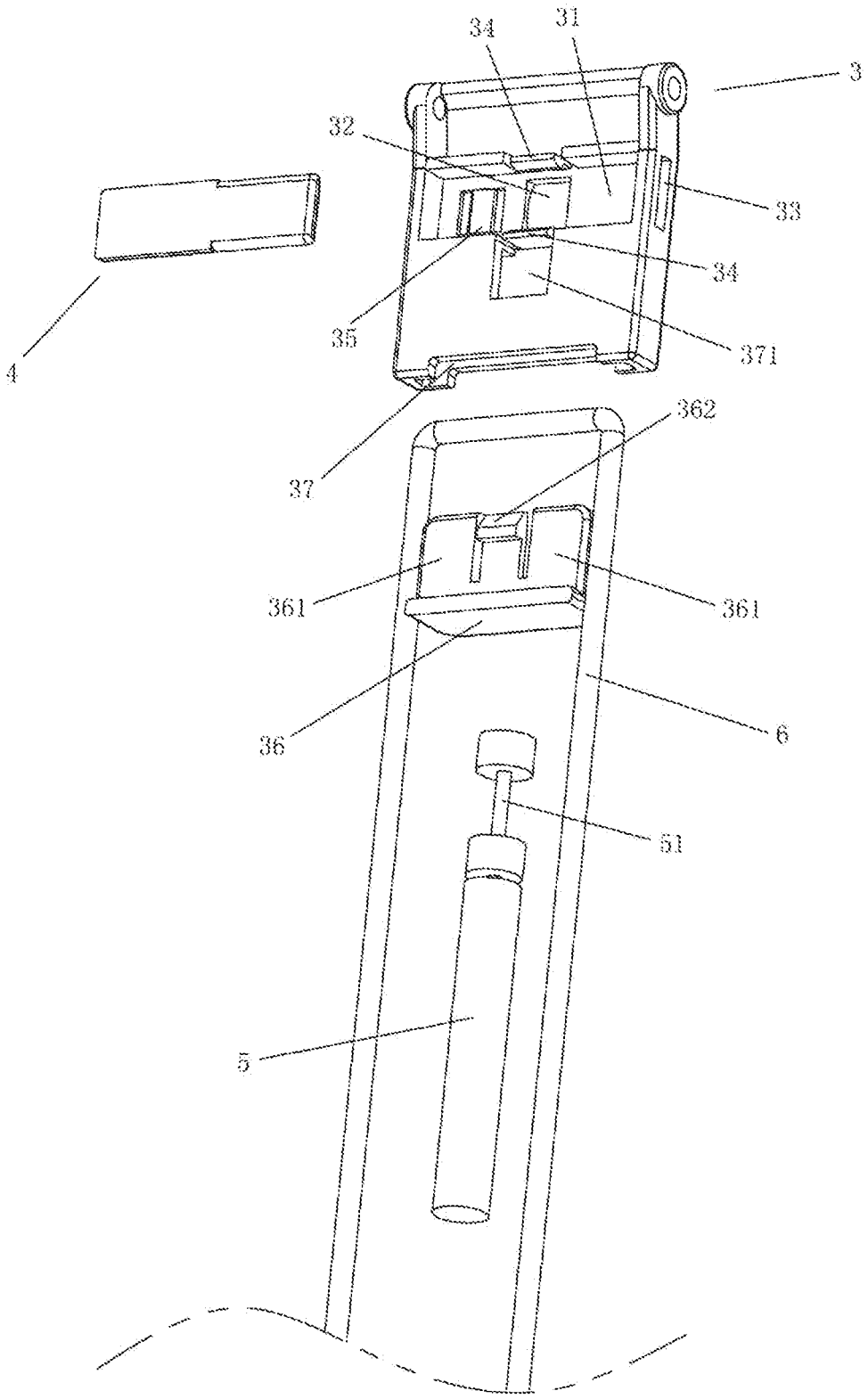
FIG. 4 is a structural schematic view of FIG. 3 from another perspective.

As shown in FIGS. 2-4, the locking member 4 is a batten-shaped lock tongue, the back surface of the support 3 is horizontally provided with a spacing groove 31 for correspondingly limiting the horizontal movement of the locking member 4, a lock opening 33 for receiving the locking member 4 is arranged at the edge of the support 3 at one side of the spacing groove 31, and the spacing hole 32 corresponds to the bottom surface of the spacing groove 31. The toggle rod 41 is a vertically extending rod corresponding to the spacing hole 32 in height. Upper and lower inner walls of the spacing groove 31 limit the locking member 4 to only horizontally go in or out of the lock opening 33, i.e. only limit the one-way movement of the locking member 4. The toggle rod 41 can only move horizontally within the range of the left and right width of the spacing hole 32, i.e. limit the movement amplitude of the locking member 4. The inner walls of the upper side and the lower side of the spacing groove 31 can be respectively or simultaneously set into a right angle shape, or the spacing groove 31 is additionally provided with a spacing component to prevent the locking member 4 from escaping from the opening of the spacing groove 31. Since the toggle rod 41 is forwards convex, preferably, the locking member 4 can only be put in from the opening of the spacing groove 31 and then mounted. The toggle rod 41 is positioned on the front side surface of the support 3 facing the user, to facilitate the visual inspection of user when the cover 2 is opened, and is simply and directly toggled leftwards and rightwards to perform the operation of locking or unlocking. The locking member 4 can be designed into other structures, for example, the locking member 4 can be designed into rotatably hooking the bin shoulder 11 through a hook-shaped part, and the locking member 4 can be horizontally or vertically rotated. In the same way, the bin shoulder 11 can also be replaced by other components to be snap-fitted.

Referring to FIG. 4, the inner walls of the upper side and the lower side of the spacing groove 31 are provided with an individual elastic inverted buckle 34, respectively, and an edge surface inclining inward obliquely towards the middle of the spacing groove 31 is arranged at the end of the inverted buckle 34. The locking member 4 is pressed on the inclined edge surface of the inverted buckle 34 in parallel when the locking member 4 is mounted, and the inverted buckle 34 is driven to elastically deform by the action of the edge surface when the locking member 4 is forcefully pressed and then is spread to the two sides, so that the locking member 4 is buckled in the spacing groove 31. Preferably, the inverted buckles 34 are positioned on the upper side and the lower side in the middle of the spacing groove 31, i.e. the upper side and the lower side of the spacing hole 32.

Referring to FIG. 4, a positioning part 42 is convexly arranged at one side of the locking member 4 facing the bottom surface of the spacing groove 31, a recessed part 35 corresponding to the positioning part 42 for limiting is arranged on the bottom surface of the spacing groove 31, the recessed part 35 is provided with at least two recessed positions matching the positioning part 42, and the bottom surface of the recessed part 35 between the recessed positions is slanted downwards in the direction of the lock opening 33 correspondingly, thereby keeping the locking member 4 naturally fixed to the locking position; the at least two recessed positions are respectively used as a locking position and an unlocking position of the locking member 4 in the spacing groove 31. Preferably, the positioning part 42 is designed into a convex strip of a semi-circle shape, an arc shape or other shapes, and preferably, the recessed positions are also correspondingly designed into a semi-circle shape, an arc shape or other shapes. When the locking member 4 moves, the positioning part 42 moves out of one recessed position of the recessed part 35 into the other due to the instantaneous elastic deformation at the position where the positioning part 42 is located.

Referring to FIGS. 3 and 4, the bin body 1 is further provided with a descent control device 5 positioned below the support 3, the descent control device 5 is provided with a strut 51 abutting against the support 3 at the top, and the lower end of the support 3 is provided with a plate abutting against the strut. The strut 51 of the descent control device 5 is provided with buffer rubbers at the end and the rod body, respectively, to strengthen the decline buffer of the cover 2, and a horizontally extending convex edge abutting against the buffer rubber is also arranged at the bottom of the abutting plate 36.

The abutting plate 36 is convexly provided with an inserting plate 361 and an inverted hook 362, the lower part of the support 3 is provided with an inserting groove 37 for corresponding insertion of the inserting plate 361 and the inverted hook 362, and a wall at one side of the inserting groove 37 is provided with an opening 371 for snap-fitted with the inverted hook 362. The convex edge of the abutting plate 36 can be used as a sealing edge for clamping the inserting groove 37.

The support 3 is connected with a connecting rod 6 of a cover prop mechanism, the top end of the connecting rod 6 is inserted in the inserting groove 37 in a matching manner, and the connecting rod 6 is tightly clamped by the abutting plate 36 and the inner wall of the inserting groove 37 together.

The top end of the connecting rod 6 is in a corresponding n-shape or L-shape and extends along the edge of the inserting plate 361 in a matching manner and is fitted with the inner wall of the inserting groove 37. Preferably, the connecting rod 6 is a single rod which is bent into a double rod structure at the top end thereof, thereby being fixedly connected by the support 3 and the abutting plate 36 through the top end, and having a compact structure and good integrated availability. The connecting rod 6 can also be set into one or two rods for connecting simultaneously. By pressing the pedal 12, the cover prop mechanism can be triggered to be rotatably hinged with the pedal at the bottom of the bin body 1 to move the connecting rod 6 upwards.

The above embodiments are only preferred embodiments of the disclosure. However, the disclosure is not limited to the above embodiments. The scope of the invention should, therefore, be determined with reference to the appended claims, along with the full scope of equivalents to which such claims are entitled.

What is claimed is:

1. A garbage bin with a cover capable of being fixedly opened, comprising a bin body, and a movably opened/closed cover mounted on the bin body, wherein:

a support is arranged at one end of the cover connected to the bin body;

a locking member capable of protruding from the support is movably arranged in the support;

a bin shoulder mounted on the bin body is provided with a through hole for the support to penetrate through in a matching manner, and the bin shoulder is snap-fitted with the locking member;

a toggle rod protruding from the support is convexly arranged at one side of the locking member facing the center of the bin body; and a spacing hole for the toggle rod to penetrate through in a matching and receiving manner is arranged at the front side of the support.

2. The garbage bin with the cover capable of being fixedly opened according to claim 1, wherein: the locking member is a batten-shaped lock tongue; the back surface of the support is horizontally provided with a spacing groove for correspondingly limiting the horizontal movement of the locking member; a lock opening for receiving the locking member is arranged at the edge of the support at one side of the spacing groove; and the spacing hole corresponds to the bottom surface of the spacing groove.

3. The garbage bin with the cover capable of being fixedly opened according to claim 2, wherein: the inner walls of the upper and lower sides of the spacing groove are provided with an individual elastic inverted buckle, respectively, and an edge surface inclining inward obliquely towards the middle of the spacing groove is arranged at the end of the inverted buckle.

4. The garbage bin with the cover capable of being fixedly opened according to claim 3, wherein: the bin body is further provided with a descent control device which is positioned below the support, the descent control device being provided with a strut abutting against the support; and the lower end of the support is provided with a plate abutting against the strut.

5. The garbage bin with the cover capable of being fixedly opened according to claim 4, wherein: the abutting plate is convexly provided with an inserting plate and an inverted hook; the lower part of the support is provided with an inserting groove for corresponding insertion of the inserting plate and the inverted hook; and a wall at one side of the inserting groove is provided with an opening for snap-fitted with the inverted hook.

6. The garbage bin with the cover capable of being fixedly opened according to claim 4, wherein: the support is connected with a connecting rod of a cover prop mechanism; the top end of the connecting rod is inserted in the inserting groove in a matching manner; and the connecting rod is tightly clamped by the abutting plate and the inner wall of the inserting groove together.

7. The garbage bin with the cover capable of being fixedly opened according to claim 6, wherein: the top end of the connecting rod is in a corresponding n-shape or L-shape and extends along the edge of the inserting plate in a matching manner and is fitted with the inner wall of the inserting groove.

8. The garbage bin with the cover capable of being fixedly opened according to claim 2, wherein: a positioning part is convexly arranged at one side of the locking member facing the bottom surface of the spacing groove; a recessed part corresponding to the positioning part for limiting is arranged on the bottom surface of the spacing groove; the recessed part is provided with at least two recessed positions matching the positioning part; and the bottom surface of the recessed part between the recessed positions is slanted downwards in the direction of the lock opening correspondingly.

9. The garbage bin with the cover capable of being fixedly opened according to claim 8, wherein: the bin body is further provided with a descent control device which is positioned below the support, the descent control device being provided with a strut abutting against the support; and the lower end of the support is provided with a plate abutting against the strut.

10. The garbage bin with the cover capable of being fixedly opened according to claim 9, wherein: the abutting plate is convexly provided with an inserting plate and an inverted hook; the lower part of the support is provided with an inserting groove for corresponding insertion of the inserting plate and the inverted hook; and a wall at one side of the inserting groove is provided with an opening for snap-fitted with the inverted hook.

11. The garbage bin with the cover capable of being fixedly opened according to claim 9, wherein: the support is connected with a connecting rod of a cover prop mechanism; the top end of the connecting rod is inserted in the inserting groove in a matching manner; and the connecting rod is tightly clamped by the abutting plate and the inner wall of the inserting groove together.

12. The garbage bin with the cover capable of being fixedly opened according to claim 11, wherein: the top end of the connecting rod is in a corresponding n-shape or L-shape and extends along the edge of the inserting plate in a matching manner and is fitted with the inner wall of the inserting groove.

13. The garbage bin with the cover capable of being fixedly opened according to claim 2, wherein: the bin body is further provided with a descent control device which is positioned below the support, the descent control device being provided with a strut abutting against the support; and the lower end of the support is provided with a plate abutting against the strut.

14. The garbage bin with the cover capable of being fixedly opened according to claim 13, wherein: the abutting plate is convexly provided with an inserting plate and an inverted hook; the lower part of the support is provided with an inserting groove for corresponding insertion of the inserting plate and the inverted hook; and a wall at one side of the inserting groove is provided with an opening for snap-fitted with the inverted hook.

15. The garbage bin with the cover capable of being fixedly opened according to claim 13, wherein: the support is connected with a connecting rod of a cover prop mechanism; the top end of the connecting rod is inserted in the inserting groove in a matching manner; and the connecting rod is tightly clamped by the abutting plate and the inner wall of the inserting groove together.

16. The garbage bin with the cover capable of being fixedly opened according to claim 15, wherein: the top end of the connecting rod is in a corresponding n-shape or L-shape and extends along the edge of the inserting plate in a matching manner and is fitted with the inner wall of the inserting groove.

17. The garbage bin with the cover capable of being fixedly opened according to claim 1, wherein: the bin body is further provided with a descent control device which is positioned below the support, the descent control device being provided with a strut abutting against the support; and the lower end of the support is provided with a plate abutting against the strut.

18. The garbage bin with the cover capable of being fixedly opened according to claim 17, wherein: the abutting plate is convexly provided with an inserting plate and an inverted hook; the lower part of the support is provided with an inserting groove for corresponding insertion of the inserting plate and the inverted hook; and a wall at one side of the inserting groove is provided with an opening for snap-fitted with the inverted hook.

19. The garbage bin with the cover capable of being fixedly opened according to claim 17, wherein: the support is connected with a connecting rod of a cover prop mechanism; the top end of the connecting rod is inserted in the inserting groove in a matching manner; and the connecting rod is tightly clamped by the abutting plate and the inner wall of the inserting groove together.

20. The garbage bin with the cover capable of being fixedly opened according to claim 19, wherein: the top end of the connecting rod is in a corresponding n-shape or L-shape and extends along the edge of the inserting plate in a matching manner and is fitted with the inner wall of the inserting groove.

* * * * *